US006464548B2

(12) United States Patent
Saito

(10) Patent No.: US 6,464,548 B2
(45) Date of Patent: Oct. 15, 2002

(54) FEMALE TERMINAL FITTING

(75) Inventor: Masashi Saito, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/940,113

(22) Filed: Aug. 27, 2001

(65) Prior Publication Data

US 2002/0025733 A1 Feb. 28, 2002

(30) Foreign Application Priority Data

Aug. 28, 2000 (JP) ..... 2000-256960

(51) Int. Cl.[7] ..... H01R 11/22
(52) U.S. Cl. ..... 439/852; 439/845; 439/843
(58) Field of Search ..... 439/851, 852, 439/842, 843, 847, 845, 849, 850

(56) References Cited

U.S. PATENT DOCUMENTS 5,061,197 A 10/1991 Kuzuno et al.
5,433,629 A 7/1995 Yagi et al.
6,152,788 A * 11/2000 Hata et al. ..... 439/852
6,171,155 B1 * 1/2001 Miwa et al. ..... 439/845

FOREIGN PATENT DOCUMENTS

EP 0 721 238 7/1996
JP 4-147580 5/1992

* cited by examiner

*Primary Examiner*—Tho D. Ta
(74) *Attorney, Agent, or Firm*—Anthony J. Casella; Gerald E. Hespos

(57) ABSTRACT

A female terminal fitting (20) has a main body (21) in the form of a rectangular tube. An elastic contact piece (27) is formed by folding back an extending part of a vertical wall (26) on the main body (21). An accommodation space (28) is defined in the main body (21) upward from the elastic contact piece (27). A male terminal fitting (10) can be inserted into the accommodation space (28) and displaced downward to bring the male terminal fitting (10) into contact with the elastic contact piece (27). Restricting projections (37, 38) project from upper and lower sides of the elastic contact piece (27) and are held in contact with a receiving portion (36) that bulges out from the vertical wall (26). The restricting projections (37, 38) prevent the elastic contact piece (27) from being deformed in response to forces exerted by the male terminal fitting (10).

6 Claims, 8 Drawing Sheets

FEMALE TERMINAL FITTING

BACKGROUND OF THE INVENTION

1. Field of the Invention

The present invention relates to a female terminal fitting.

2. Description of the Related Art

Male and female terminal fittings typically are connected with one another by first positioning the terminal fittings with their longitudinal axes aligned and then moving the terminal fittings toward one another. Terminal fittings of this general type are disclosed in Japanese Unexamined Patent Publication No. 4-147580. In this example, an elastic contact piece is provided in a tubular main body of a female terminal fitting by folding a side wall to extend along longitudinal direction. A male terminal fitting is inserted-into the main body from the front along the longitudinal direction. Thus, the male terminal fitting contacts and deforms the elastic contact piece. At this time, the male terminal fitting is held elastically while being squeezed between the elastic contact piece and the side wall of the main body that faces the elastic contact piece.

This connecting method requires the male terminal fitting to be inserted to a sufficient depth for the male and female terminals to be held stably in contact with each other. The time and distance over which the male terminal fitting is held in sliding contact with the elastic contact piece while being subjected to a contact pressure tends to be long. Thus, a larger force is required for the connecting operation due to frictional resistance between the sliding contact portions. Further, the sliding contact portions of the male terminal fitting and the elastic contact piece may be abraded.

As a countermeasure, the male terminal fitting can be brought into contact with the elastic contact piece sideways along the widthwise direction of the elastic contact piece. Specifically, the male terminal fitting is inserted into the main body to a position displaced laterally from the elastic contact piece. The terminal fittings then are displaced in directions such that the male terminal fitting and the elastic contact piece are brought into contact with each other. Such an arrangement can shorten the sliding contact period and distance of the two terminal fittings from the start to the end of contact as compared with male and female terminal fittings connected along their longitudinal directions. As a result, a force necessary to connect the two terminal fittings can be reduced.

However, forces generated by bringing the male terminal fittings laterally into contact with the elastic contact piece may twist and deform the male terminal fitting about its longitudinal axis. In addition, the elastic contact piece may be bent and deformed such that its longitudinal axis is shaken in the widthwise direction about the folded section at the front end of the female terminal fitting.

Upon occurrence of either situation, there is a possibility of an unstable connection between the two terminal fittings.

The present invention was developed in view of the above situations, and an object thereof is to prevent an elastic or resilient contact piece from being deformed.

SUMMARY OF THE INVENTION

The invention is directed to a female terminal fitting, comprising a main body, and at least one resilient or elastic contact piece. The main body of the female terminal fitting may be substantially tubular, and the elastic or resilient contact piece may be formed by folding a side wall of the main body back to extend in longitudinal direction. A male terminal fitting can be inserted into the main body and then brought into contact with the resilient contact piece. More particularly, the male terminal fitting initially is moved into a position in the main body where the male terminal fitting and the elastic contact piece are laterally offset and spaced from one another. The male terminal fitting and/or the resilient contact piece then are displaced laterally or transversely relative to one another and into a position where the male terminal fitting is in contact with the resilient contact piece.

The resilient contact piece may comprise at least one twist-restricting portion that can be brought into contact with a side wall of the main body to prevent the resilient contact piece from being twisted about its longitudinal axis as the male terminal fitting is brought into contact with the resilient contact piece. Accordingly, a twisting of the resilient or elastic contact piece due to the frictional force of the male terminal fitting can be prevented effectively.

The twist-restricting portion preferably may be configured to contact a portion of a side wall of the main body that bulges toward the resilient contact piece. Additionally, the twist-restricting portion may comprise at least one projection that projects laterally from the resilient contact piece.

The width of the contact area of the elastic contact piece with the side wall can be made larger than the width of the elastic contact piece by holding the twist-restricting portion in contact with the side wall at a position that extends laterally from the elastic contact piece. Thus, the elastic contact piece can be prevented from being twisted and deformed about its longitudinal axis as the male terminal fitting is brought into contact with the elastic contact piece from a laterally displaced position.

The resilient contact piece may comprise at least one shake-restricting portion instead of the twist-restricting portion. The shake-restricting portion can be brought into contact with a wall surface of the main body at a back side with respect to the displacing direction of the male terminal fitting relative to the resilient contact piece. The contact of the shake restricting portion with the wall surface of the main body prevents the elastic contact piece from being bent and deformed such that its longitudinal axis is shaken in the widthwise direction as the male terminal fitting is brought laterally into contact with the elastic contact piece.

In a preferred embodiment, the elastic contact piece may comprise both a twist-restricting portion and a shake-restricting portion. The twist-restricting portion can be brought into contact with the side wall at a position extending out along widthwise direction and can prevent the elastic contact piece from being twisted about its longitudinal axis as the male terminal fitting is brought into contact with the elastic contact piece. The shake-restricting portion can be brought into contact with a wall surface of the main body at a back side with respect to the displacing direction of the male terminal fitting relative to the elastic contact piece and can prevent the elastic contact piece from being displaced such that the longitudinal axis of the elastic contact piece is shaken in the widthwise direction.

The contact of the twist-restricting portion and the shake-restricting portion with the wall surface of the main body prevents the elastic contact piece from being twisted about its longitudinal axis and from being bent such that its longitudinal axis is shaken in widthwise direction as the male terminal fitting is brought laterally into contact with the elastic contact piece.

Preferably, the resilient contact piece is angled to define a peak substantially at the longitudinal center.

The resilient or elastic contact piece may comprise a guiding portion for guiding the displacement of the male terminal fitting. The guiding portion can smoothen both a contacting action of the male terminal fitting with the elastic contact piece and an elastic deformation of the elastic contact piece.

The main body may include an accommodation space offset laterally from the resilient contact piece. The male terminal fitting may be inserted in a first direction into the accommodation space and brought into contact with the resilient contact piece along a second direction arranged at an angle to the first direction.

The main body may comprise a protection wall partially covering the resilient contact piece to prevent the male terminal fitting from being inserted into a space of the main body where it cannot resiliently contact the resilient contact piece.

Most preferably, the male terminal fitting is insertable between the resilient contact piece and a second side wall. The second side wall preferably comprises an inwardly bulging portion that at least partly substantially faces the resilient contact piece.

These and other objects, features and advantages of the present invention will become apparent upon reading of the following detailed description of preferred embodiments and accompanying drawings.

DETAILED DESCRIPTION OF THE PREFERRED EMBODIMENT

Figure 1:
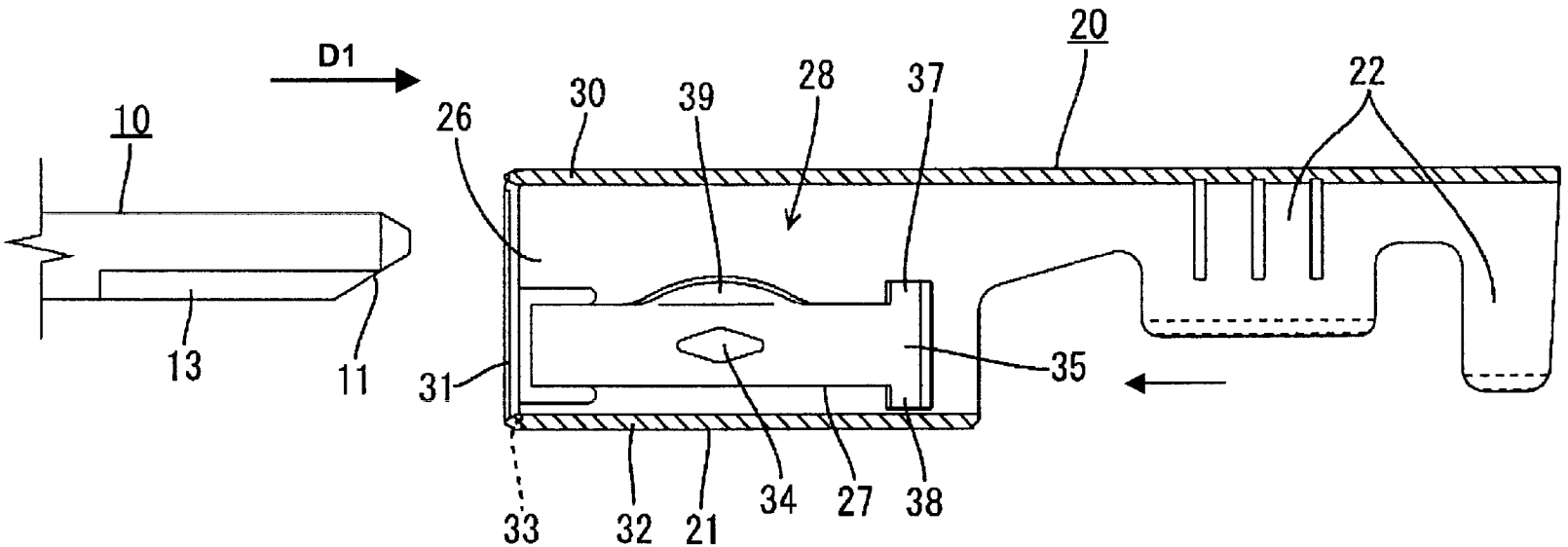
FIG. 1 is a side view in section of a female terminal fitting according to one embodiment of the invention.
Figure 4:
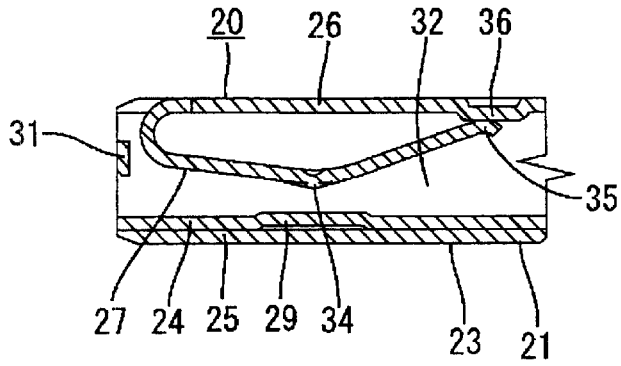
FIG. 4 is a plan view in section of the female terminal fitting.
Figure 5:
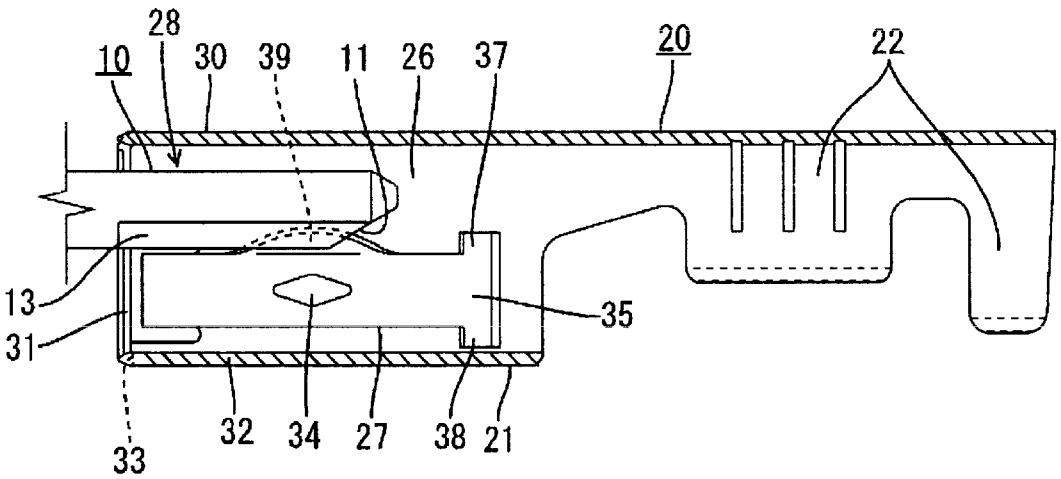
FIG. 5 is a side view in section showing the female terminal fitting in a state after a male terminal fitting is inserted along its longitudinal direction.
Figure 6:
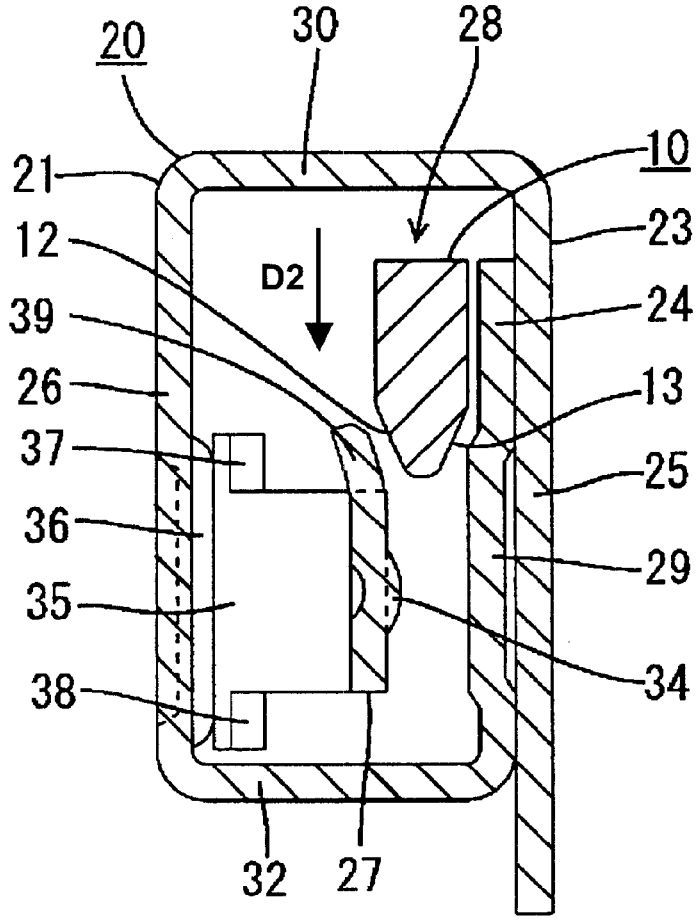
FIG. 6 is a lateral section of the female terminal fitting in a state of FIG. 5.

One preferred embodiment of the present invention includes a female terminal fitting 20 to be electrically connected with a substantially tab-shaped male terminal fitting 10, as shown in FIGS. 1 to 11. The terminal fittings 10 and 20 are connected by initially displacing at least one of the terminal fittings 10 and 20 along the longitudinal direction D1, as shown in FIG. 1. Connection is completed by displacing at least one of the terminal fittings 10 and 20 in direction D2, as shown in FIG. 6. The direction D2 is aligned at an angle different from 0° and 180°, and preferably substantially normal to the longitudinal direction D1. Accordingly, the male and female terminal fittings 10 and 20 are displaced laterally with respect to each other to bring a resilient or elastic contact piece of the female terminal fitting 20 into contact with the male terminal fitting 10, as described below.

The male terminal fitting 10 preferably is a long narrow plate with a base end (not shown) and a leading end, as shown in FIG. 1. The male terminal fitting 10 further has a slanted surface 11 that extends from the leading end to a bottom edge. The outer periphery of the leading end of the male terminal fitting 10 is tapered, and bottom parts of the side surfaces also are tapered over a specified length from the leading end to form slanted surfaces 12 and 13. As shown in FIG. 6, an angle of inclination of the slanted surface 12 facing an elastic contact piece 27 is set larger than that of the slanted surface 13.

The female terminal fitting 20 is formed e.g. of a metallic plate using a press, and has a main body 21 and a barrel 22. The main body 21 is at the front end of the female terminal fitting 20 and defines a substantially rectangular tube that is hollow in forward and backward directions. The male terminal fitting 10 is configured for insertion into the main body 21 from the front along the longitudinal direction D1 of the female terminal fitting 20. The barrel 22 is at the rear end of the female terminal fitting 20 and is configured to be crimped, bent or folded into connection with an unillustrated wire.

Figure 2:
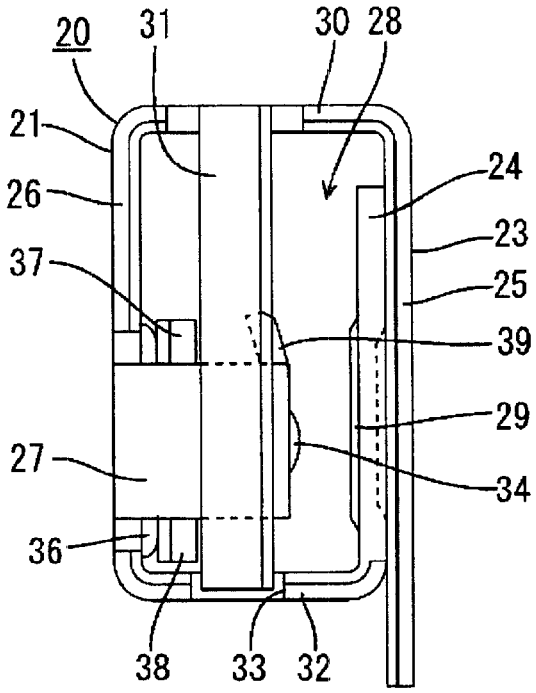
FIG. 2 is a front view of the female terminal fitting.
Figure 3:
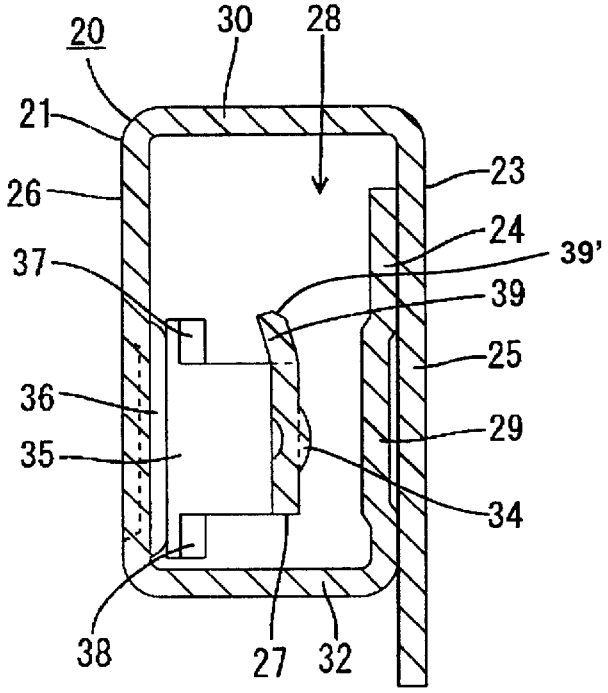
FIG. 3 is a lateral section of the female terminal fitting.

The main body 21 has a cross section that is substantially rectangular or narrow and long along height direction, as shown in FIGS. 2 and 3. A first or right vertical wall 23 preferably has a double wall construction comprised of an inner plate 24 and an outer plate 25 that are disposed substantially one over the other. A second or left vertical wall 26 is formed with an elastic contact piece 27 used for the electrical connection with the male terminal fitting 10. The elastic contact piece 27 preferably is slightly below the vertical center, and an accommodation space 28 is defined obliquely upward from the elastic contact piece 27 to the right or towards the first vertical wall 23. The accommodation space 28 is dimensioned for at least partly accommodating the male terminal fitting 10 prior to connection with the elastic contact piece 27, as explained further below. The position of the male terminal fitting 10 accommodated in the accommodation space 28 is referred to as an initial position, and is shown in FIGS. 5 and 6.

A portion of the inner plate 24 that substantially faces the elastic contact piece 27 is formed into a bulging portion 29 that bulges toward the elastic contact piece 27. Thus, the male terminal fitting 10 can be brought into contact with the elastic contact piece 27, and can be held between the elastic contact piece 27 and the bulging portion 29. The bulging portion 29 preferably is slightly elastically or resiliently deformable toward the outer plate 25. An inwardly bulging slanted surface of the bulging portion 29 can guide the male terminal fitting 10.

A protection wall 31 extends from an upper horizontal wall 30 at the front end of the main body 21 and partially covers a front area of the elastic contact piece 27, as shown in FIG. 2. The protection wall 31 has an extending end that is fitted in a recess 33 formed in a lower horizontal wall 32 so as to position and hold the protection wall 31 properly. The protection wall 31 prevents the male terminal fitting 10 from being inserted improperly, and hence protects the elastic contact piece 27 from being damaged by an improper insertion of the male terminal fitting 10 into the female terminal fitting 20.

Figure 11:
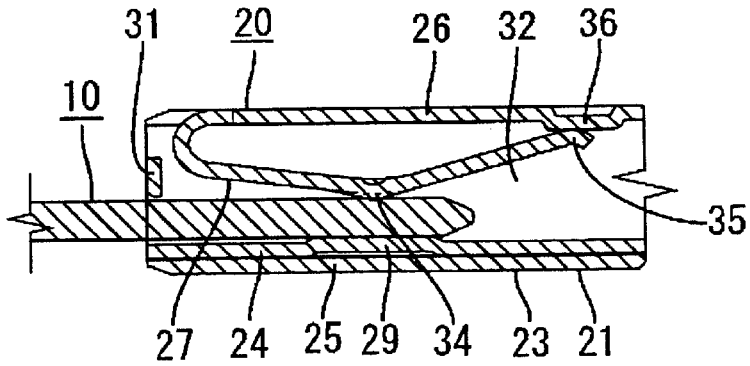
FIG. 11 is a plan view in section of the female terminal fitting in the state of FIG. 9.

The elastic contact piece 27 is formed by folding back a tongue that extends longitudinally from the front end of the second vertical wall 26 in the form of a cantilever. The elastic contact piece 27 is angled or bent, as shown in FIG. 11, to define a peak that projects toward the first side wall 23 substantially at the longitudinal center of the elastic contact piece 27. A contact portion 34 is formed, preferably by embossing, to project at the peak.

The male terminal fitting 10 can be moved in direction D1 into the initial position in the accommodation space 28, as shown in FIG. 5. The male terminal fitting 10 then can be displaced down in direction D2 with respect to the female terminal fitting 20 and into contact with the elastic contact piece 27, as shown in FIG. 6. As a result, the elastic contact piece 27 is deformed elastically or resiliently, and the contact portion 34 is displaced toward the vertical wall 26. The restoring forces of the elastic contact piece 27 urge the contact portion 34 into electrical contact with the male terminal fitting 10. Connection is completed when the male terminal fitting 10 reaches the connecting position shown in FIGS. 9 to 11.

The elastic contact piece 27 has a front end that extends unitarily from the vertical wall 26 and a rear end 35 that is in contact with the inner surface of the vertical wall 26, as shown in FIG. 4. The vertical wall 26 is embossed inwardly to form a receiving portion 36 that contacts the rear end 35 of the elastic contact piece 27. Thus, forces acting on the elastic contact piece 27 are received partly by the front end of the vertical wall 26 that is connected unitarily with the base end of the elastic contact piece 27 and partly by the receiving portion 36 that contacts the rear end 35 of the elastic contact piece 27.

As shown in FIGS. 1 and 3, restricting projections 37 and 38 project upward and downward from the upper and lower edges of the rear end 35 of the elastic contact piece 27. The restricting projections 37 and 38 and the rear end 35 of the elastic contact portion all are in contact with the receiving portion 36 of the vertical wall 26. Thus, a contact area between the elastic contact piece 27 and the receiving portion 36 is larger than the width of the elastic contact piece 27 by the projecting dimensions of the restricting projections 37 and 38. The projecting dimensions of the restricting projections 37 and 38 are substantially equal, as shown in FIG. 3.

The lower restricting projection 38 has a projecting or bottom end that is proximate to or in contact with the inner surface of the lower horizontal wall 32. Accordingly, a downward force on the elastic contact piece 27 will urge the restricting projection 38 into engagement with the horizontal wall 32.

A guiding portion 39 projects upward and toward the accommodation space 28 from a longitudinally middle part of the upper edge of the elastic contact piece 27. The guiding portion 39 is moderately arcuately convex in the longitudinal direction, as shown in FIG. 1, and is bent to incline toward the second vertical wall 26 in the widthwise direction of the elastic contact piece 27, as shown in FIG. 3. The guiding portion 39 is at a height that at least partly overlaps the male terminal fitting 10 in the accommodation space 28 and is located obliquely downward to the left or toward the second vertical wall 26 from the male terminal fitting 10, as shown in FIG. 6. Thus, the male terminal fitting 10 can be brought into contact with the guiding portion 39 by displacing the male terminal fitting 10 down toward the contact position. In this way, the guiding portion 39 guides the male terminal fitting 10 into a position for elastically or resiliently deforming the elastic contact piece 27. A corner 39' of the guiding portion 39 that faces both the accommodation space 28 and the male terminal fitting 10 is slanted. Further, the rear end of the guiding portion 39 is at substantially the same position as the leading end of the male terminal fitting 10 in the accommodation space 28, as shown in FIG. 5.

In this embodiment, the restricting projections 37, 38 both act as twist restricting portions, and the lower restricting projection 38 can serve also as a shake restricting portion.

The terminal fittings 10 and 20 are connected by relatively displacing the terminal fittings 10 and 20 toward each other along their longitudinal directions D1 with the male terminal fitting 10 in a position upward from the elastic contact piece 27, as shown in FIG. 1. Thus, the male terminal fitting 10 is inserted into the main body 21 through an opening between the protection wall 31 and the inner plate 24 and enters the accommodation space 28 above the elastic contact piece 27, as shown in FIGS. 5 and 6. The male terminal fitting 10 is inserted in direction D1 to the initial position in the accommodation space 28 at which the leading end of the male terminal fitting 10 substantially aligns with the rear end of the guiding portion 39. At this time, the male terminal fitting 10 is at a position close to both the inner plate 24 of the main body 21 and the guiding portion 39 of the elastic contact piece 27. However, the male terminal fitting 10 is not yet properly connected with the female terminal fitting 20. The male terminal fitting 10 is brought closer to the elastic contact piece 27 by relatively displacing the terminal fittings 10 and 20 in directions D2 which define an angle different from 0° or 180°, and preferably substantially normal to the longitudinal directions D1.

Figure 7:
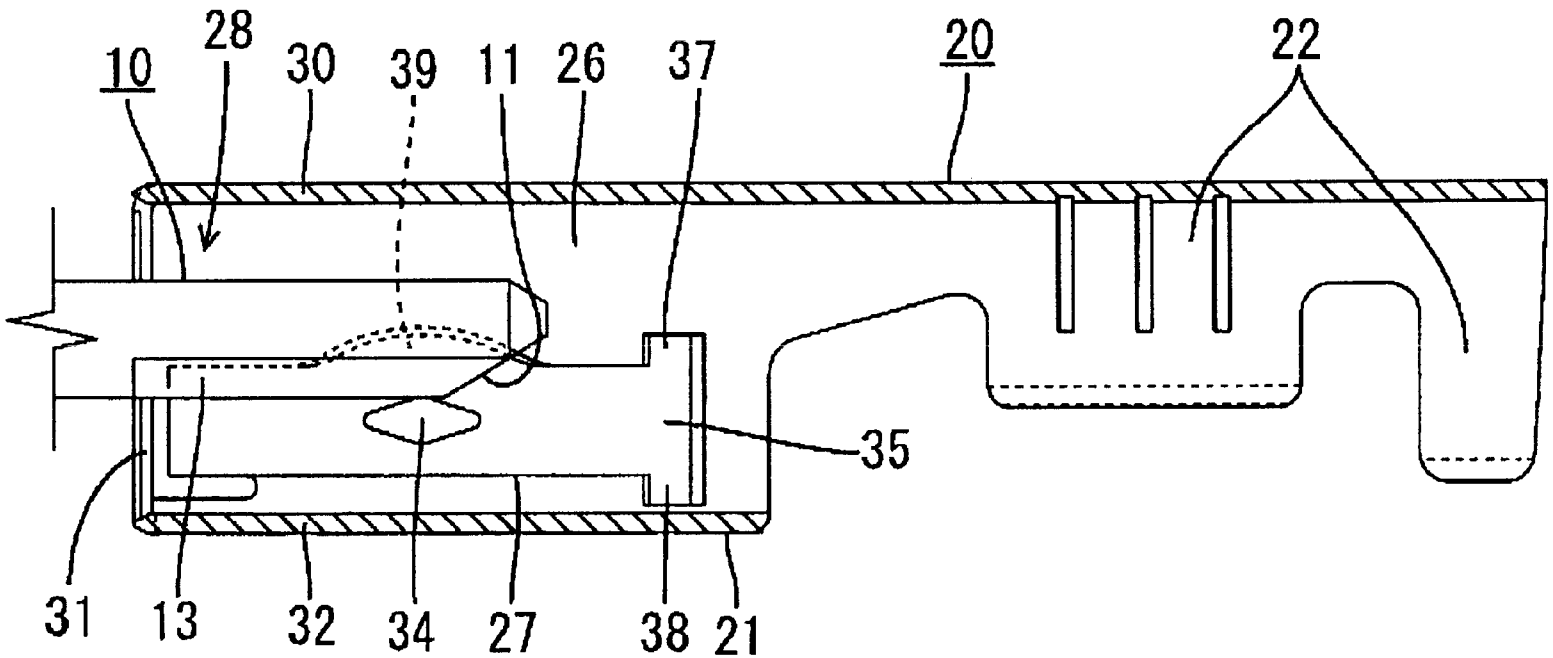
FIG. 7 is a side view in section showing the female terminal fitting at an initial stage of contact of the male terminal fitting with an elastic contact piece.
Figure 8:
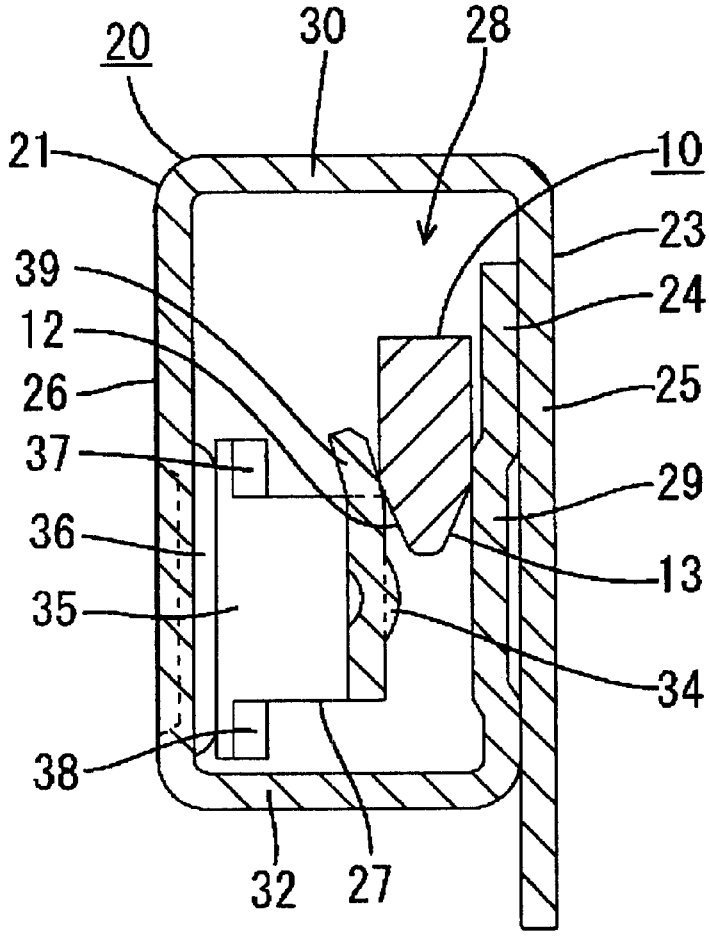
FIG. 8 is a lateral section of the female terminal fitting in a state of FIG. 7.
Figure 9:
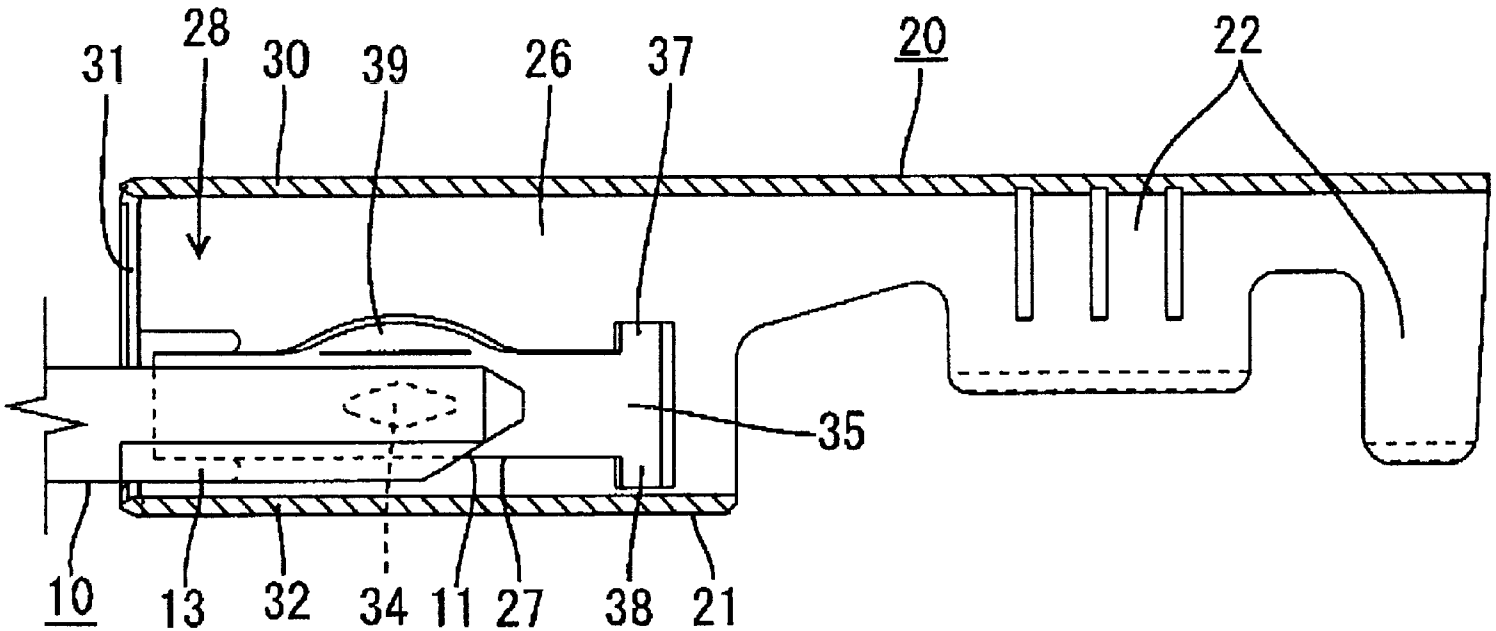
FIG. 9 is a side view in section of the female terminal fitting after completion of connection of the male terminal fitting.
Figure 10:
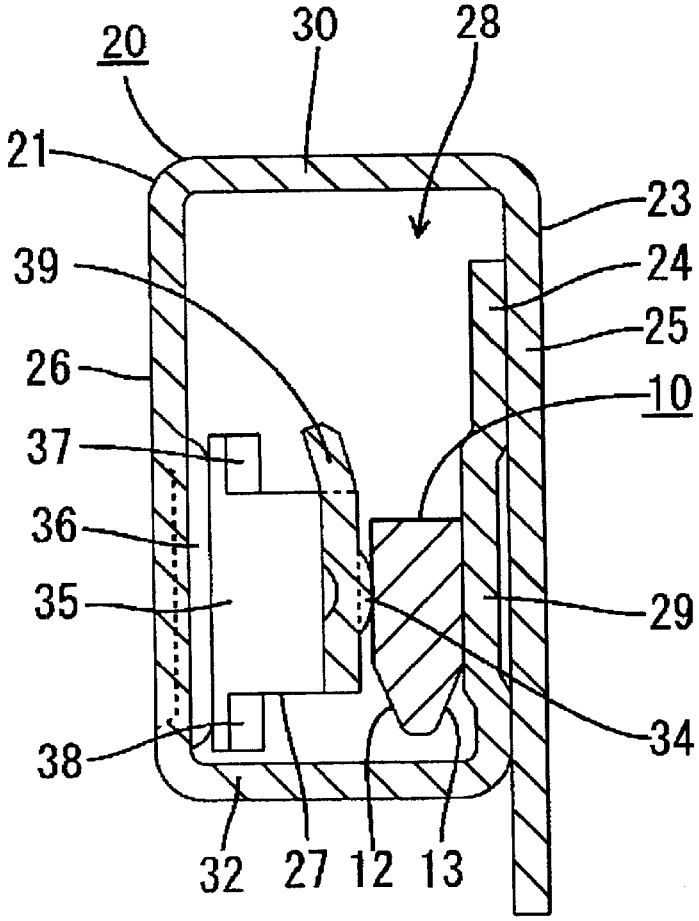
FIG. 10 is a lateral section of the female terminal fitting in a state of FIG. 9.

The downward displacement in direction D2 brings the male terminal fitting 10 into contact with the guiding portion 39, as shown in FIGS. 7 and 8. Thus, a contact starting action of the male terminal fitting 10 with the elastic contact piece 27 and a resulting elastic deformation of the elastic contact piece 27 are performed smoothly.

The force acting on the elastic contact piece 27 unavoidably is unbalanced in a widthwise direction or in the vertical displacing direction D2 of the male terminal fitting 10 because the contact area of the male terminal fitting 10 with the elastic contact piece 27 gets larger as the male terminal fitting 10 is displaced downward along the direction D2 after being held in contact with the upper end of the elastic contact piece 27. However, the two restricting projections 37 and 38 are held in contact with the receiving portion 36 together with the rear end portion 35 of the elastic contact piece 27. Therefore, the contact area of the elastic contact piece 27 with the receiving portion 36 can be larger than the width of the elastic contact piece 27 by the dimensions of the restricting projections 37 and 38. Thus, the elastic contact piece 27 can be supported more stably, thereby preventing the elastic contact piece 27 from being twisted and deformed about its longitudinal axis.

The elastic contact piece 27 is pressed down along the displacement direction D2 by the male terminal fitting 10. However, a downward pivotal displacement of the rear end of the elastic contact piece 27 about the folded portion at the front end of the elastic contact piece 27 can be prevented by the contact of the lower restricting projection 38 with the lower horizontal wall 32. In other words, the contact of the lower restricting projection 38 with the lower horizontal wall 32 prevents the elastic contact piece 27 from being bent and deformed in a manner that would cause its longitudinal axis to be shaken or bent along the widthwise direction.

The slanted surface 12 adjacent the bottom of the male terminal fitting 10 passes the contact portion 34, and the flat side surface above the slanted surface 12 slides into contact with the contact portion 34 as the male terminal fitting 10 reaches the connecting position. Relative displacement of the terminal fittings 10, 20 then can be stopped because the male terminal fitting 10 is connected properly and is held elastically between the contact portion 34 of the elastically deformed elastic contact piece 27 and the bulging portion 29.

The elastic contact piece 27 is prevented from a twisting deformation about its longitudinal axis because an area wider than the elastic contact piece 27 receives forces exerted by the male terminal fitting 10 on the elastic contact piece 27. More particularly, the wide area defined by the restricting projections 37 and 38 are held in contact with the receiving portion 36. Further, the lower restricting projection 38 is brought into contact with the horizontal wall 32 when the male terminal fitting 10 presses the elastic contact piece 27 down. This contact prevents the elastic contact piece 27 from being bent or deformed in a direction that would cause its longitudinal axis to be shaken along the widthwise direction.

The guiding portion 39 that projects from the elastic contact piece 27 toward the accommodation space 28 guides the contacting action of the male terminal fitting 10 with the elastic contact piece 27 and smoothes the elastic deformation of the elastic contact piece 27.

The present invention is not limited to the above described and illustrated embodiment. For example, following embodiments are also embraced by the technical scope of the present invention as defined in the claims. Beside the following embodiments, various changes can be made without departing from the scope and spirit of the present invention as defined in the claims.

Although a pair of upper and lower restricting projections are provided in the foregoing embodiment, substantially the same function as the foregoing embodiment can be fulfilled even if the upper restricting projection is omitted since the lower restricting projection is provided with both the twist-restricting function and the shake-restricting function.

Although the restricting projections are provided at the rear end of the elastic contact piece in the foregoing embodiment, the positions thereof can be arbitrarily selected. For example, the twist-restricting function and the shake-restricting function can be fulfilled even if the restricting projections are provided near the middle of the elastic contact piece and adjacent to the contact portion.

The lower restricting projection is provided with both the twist-restricting function and the shake-restricting function in the foregoing embodiment. However, the lower restricting projection, for example, located at a position distanced from the lower horizontal wall and provided only with the twist-restricting function also is embraced by the present invention. Conversely, the lower restricting projection that is not in contact with the receiving portion and is provided only with the twist-restricting function also is embraced by the present invention.

Although the elastic contact piece is provided with the guiding portion for guiding the male terminal fitting in the foregoing embodiment, the guiding portion may be omitted according to the present invention.

The elastic contact piece is provided with two opposite restricting projections at a leading end thereof. However, the elastic contact piece may be formed with only two restricting portions at one lateral side, and preferably on the side of the elastic contact piece facing the lower horizontal wall. Alternatively, only one or at least three projections may be provided on either or both lateral sides of the elastic contact piece.

What is claimed is:

1. A female terminal fitting comprising: a substantially tubular main body having at least one side wall and a substantially open front end, an elastic contact piece extending from the at least one side wall at said front end and bent rearward into the tubular main body, such that a rear portion of the elastic contact piece spaced rearward from the front end engages the at least one side wall, and at least one restricting portion extending transversely from the elastic contact piece and contacting the at least one side wall for resisting moments applied to the elastic contact piece by a mating male terminal fitting.

2. A female terminal fitting according to claim 1, wherein the main body comprises a protection wall partially covering the resilient contact piece for preventing the male terminal fitting from being inserted into a space of the main body where it cannot be resiliently brought into contact with the resilient contact piece.

3. The female terminal fitting of claim 1, wherein the at least one side wall is a first side wall, said main body further comprising a second side wall, a top wall and a bottom wall, the elastic contact piece being closer to the top wall than to the bottom wall.

4. The female terminal fitting of claim 3, wherein the at least one restricting portion is a lower restricting portion and extends into proximity with the bottom wall.

5. The female terminal fitting of claim 4, further comprising an upper restricting portion extending from the elastic contact piece toward the top wall.

6. The female terminal fitting of claim 5, wherein the elastic contact piece further comprises a guiding portion angled toward the first side wall and toward the top wall for guiding the mating male terminal fitting between the elastic contact piece and the second side wall.

* * * * *